United States Patent [19]

Sumi

[11] 4,305,698

[45] Dec. 15, 1981

[54] RADIAL-FLOW TURBINE WHEEL

[75] Inventor: Yasuo Sumi, Yokohama, Japan

[73] Assignee: Nissan Motor Co., Ltd., Yokohama, Japan

[21] Appl. No.: 49,350

[22] Filed: Jun. 18, 1979

[30] Foreign Application Priority Data

Oct. 12, 1978 [JP] Japan ..... 53/139178[U]

[51] Int. Cl.[3] ..... F01D 5/14

[52] U.S. Cl. ..... 416/188; 416/197 R

[58] Field of Search ..... 416/185, 188, 197 R, 416/186; 415/205

[56] References Cited

U.S. PATENT DOCUMENTS

| | | | |
|---|---|---|---|
| 45,875 | 1/1865 | Stewart | 415/205 |
| 253,267 | 2/1882 | Davidson | 416/186 |
| 1,055,487 | 3/1913 | Papin | 415/205 |

FOREIGN PATENT DOCUMENTS

| | | | |
|---|---|---|---|
| 269616 | 1/1914 | Fed. Rep. of Germany | 416/185 |
| 501250 | 11/1954 | Italy | 416/186 |
| 16592 | of 1908 | United Kingdom | 416/185 |

*Primary Examiner*—Leonard E. Smith

*Attorney, Agent, or Firm*—Thompson, Birch, Gauthier & Samuels

[57] ABSTRACT

A radial flow turbine wheel comprises a disc, a spindle and blades, each blade having a curved surface configuration in symmetry with respect to a plane which is normal to the spindle and which passes through a mid portion of the axial length of the disc, thereby eliminating the creation of a net axial thrust force caused by an imbalance of the axial component forces of gas flow acting on the blades.

4 Claims, 12 Drawing Figures

RADIAL-FLOW TURBINE WHEEL

BACKGROUND OF THE INVENTION

1. Field of the Invention

This invention relates to a radial-flow turbine wheel for use in rotors for turbo-chargers, gas turbine engines and the like.

2. Description of the Prior Art

A radial-flow turbine wheel consists generally of blades and disc which are usually integrally formed by precision forging or cutting and provided with a spindle passing therethrough. The blades are usually so shaped in consideration of facility in manufacture that upstream portions of the blades are substantially parallel to the spindle and downstream portions are bent as viewed in radial directions. When gas flows through the turbine wheel, component forces of the gas flow acting normal to surfaces of the blades drive the turbine wheel. At the same time, an imbalance of axial component forces of the gas flow produces a net axial thrust force which in turn produces frictional forces opposing rotation with resulting losses of driving forces.

SUMMARY OF THE INVENTION

It is therefore an object of the invention to provide an improved radial-flow turbine wheel which eliminates the loss of driving forces due to axial thrust forces.

In order to achieve this objective, the radial-flow turbine wheel according to the invention comprises blades and a disc, each said blade having a curved surface configuration in symmetry with respect to a plane normal to a spindle of said wheel and passing through a mid portion of the axial length of said disc.

The invention will be more fully understood by referring to the following detailed specification and claims taken in connection with the appended drawings.

DETAILED DESCRIPTION OF THE PREFERRED EMBODIMENTS

Figure 1:
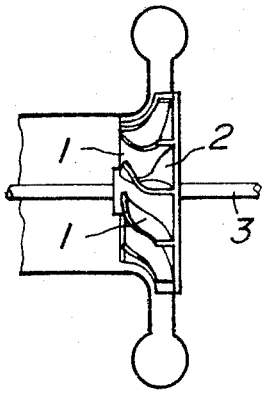
FIG. 1 PRIOR ART
FIG. 1 is a side view of a prior art radial-flow turbine wheel arranged in a gas flow passage.
Figure 2:
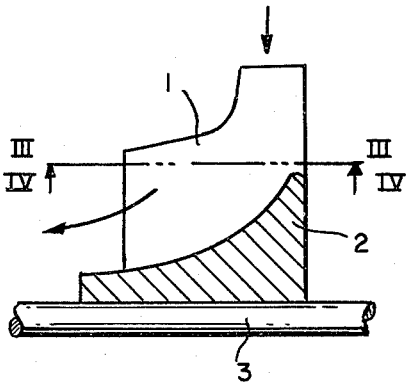
FIG.2 PRIOR ART
FIG. 2 is an enlarged partial sectional view of the turbine wheel in FIG. 1.

Referring to FIGS. 1 and 2 which are a side view and a partially enlarged sectional view of a radial-flow turbine wheel or disc of the prior art (referred to as "rotor" hereinafter) arranged in a gas flow passage, the rotor consists of blades 1 and a disc 2 which are usually integrally formed by precision forging or cutting and provided with a spindle 3 passing therethrough as shown in the drawings. The blades are so shaped in view of facility in manufacture that inlet portions of the blades are substantially parallel to the spindle 3 and outlet portions are curved as shown in FIGS. 3 and 4.

Figure 3:
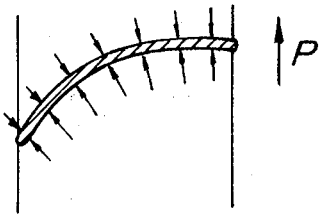
FIG. 3 PRIOR ART
FIG. 3 is a sectional view taken on line 3—3 of FIG. 2 schematically depicting forces normal to curved surfaces of the blade.
Figure 4:
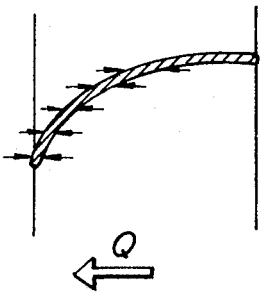
FIG. 4 PRIOR ART
FIG. 4 is a sectional view taken on line 4—4 of FIG. 2 schematically depicting forces acting upon the blade in an axial direction.

Accordingly, when gas flows into and through the rotor as shown by the arrows in FIG. 2 (illustrating only one component parallel to the plane of the drawing, although in fact the flowing directions are oblique to the plane), components of the gas flow act normally on surfaces of the blades as shown by the small arrows in FIG. 3 to drive the rotor in a direction p. At the same time, other axial force components produce a net axial thrust force Q to cause frictional forces opposing rotation resulting in losses of driving forces.

Figure 5:
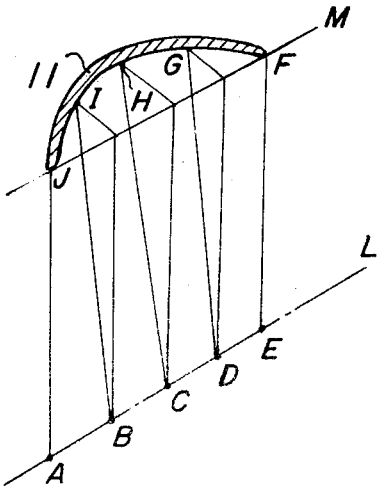
FIG. 5 is a schematic perspective view showing the relationship of a cross-section of a blade of the present invention to the rotational axis of the spindle.
Figure 6:
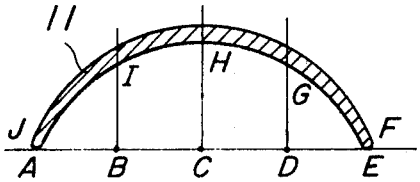
FIG. 6 is a sectional view taken along line 6—6 of FIG. 7.
Figure 7:
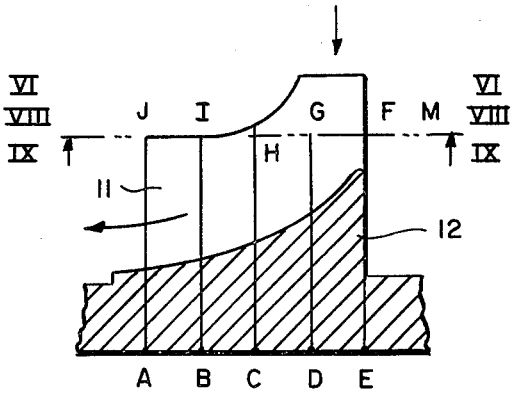
FIG. 7 is an enlarged partial sectional view of a turbine wheel in accordance with the present invention.

In contrast to the above, blades 11 of a rotor according to the present invention include surfaces shown at A-B-C-D-E-F-G-H-I-J curved relative to the plane including a rotating axis L and a line M parallel thereto as shown in FIGS. 5–7. The curved surface is in symmetry with respect to a plane passing through the proximity of a center C of the axial length of the disc 12 (as shown by the line C—H passing through an apex H of the blade 11 in FIG. 6).

Figure 8:
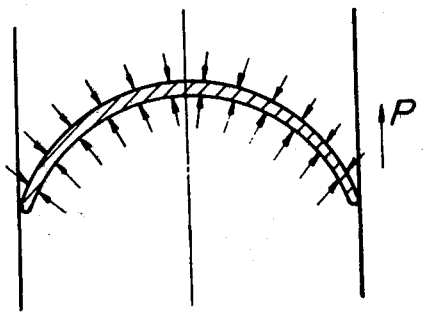
FIGS. 8 and 9 are additional sectional views taken on lines 8—8 and 8—9 of FIG. 7, and FIGS. 10 and 11 illustrate alternate embodiments of the turbine wheels according to the present invention.
Figure 9:
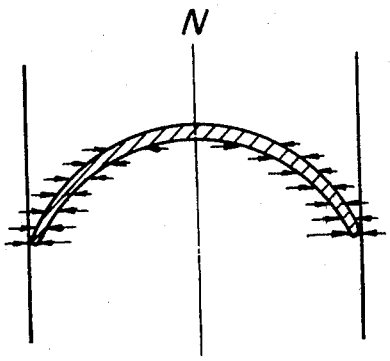

Therefore, when gas flows through the rotor as shown by the arrows in FIG. 7, component forces of the gas flow normal to the curved surfaces of the blades act thereupon to rotate the blade in the direction of arrow P as shown in FIG. 8.

At the same time, axial forces act in opposite directions on both sides of a center line N normal to the axis of the rotor so as to be balanced to each other. As the result, the rotor is not subjected to any net axial thrust force and therefore any resistance against rotation does not occur, so that the loss of the driving forces is minimized according to the invention.

Figure 10:
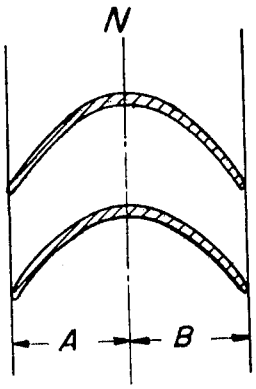
Figure 11:
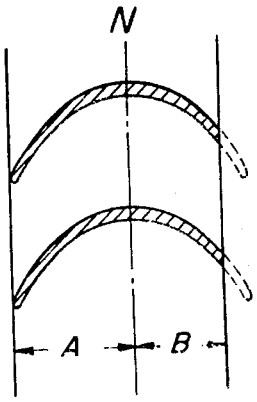
Figure 12:
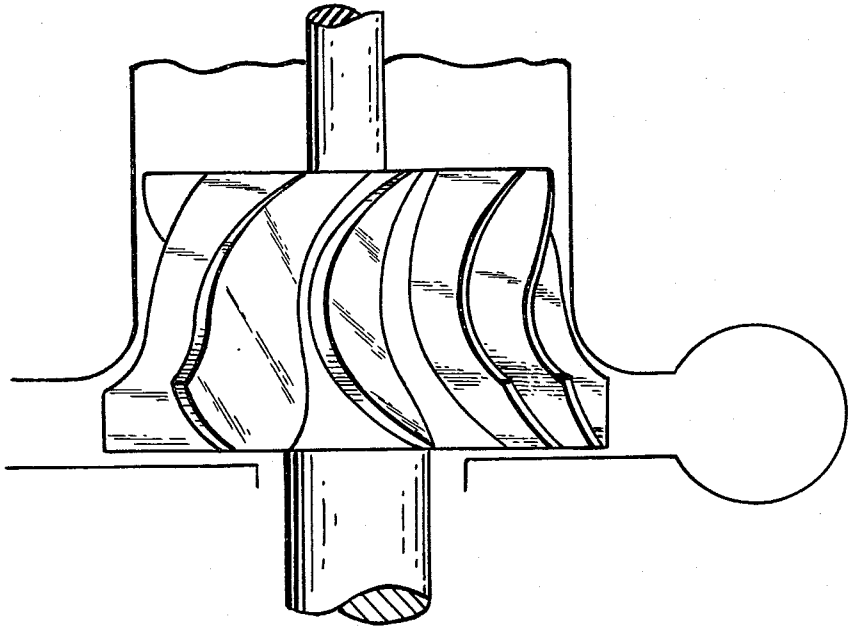
FIG. 12 is a side view of a radial flow turbine wheel in accordance with the present invention.

FIG. 10 illustrates one embodiment of the rotor according to the present invention which is completely in symmetry not only with respect to the curved configuration of blades but also with respect to the axial length A-B. FIG. 11 illustrates another embodiment of a rotor according to the present invention which is with respect to the symmetry in curved configuration of blades but is asymmetrical with respect to the axial length of downstream and upstream portions A, B of the blades. In this embodiment, the length A is more then B. The difference between the lengths A and B may be allowed in practice to an extent of A:B=2:1.

In the embodiment of FIG. 11 which is asymmetrical in axial length, the pressure of the flowing gas on the upstream side of the blade is generally higher than that on the downstream side, so that the axial forces on both sides of the center line N may be balanced.

According to the invention, as above described the configuration of blades of the radial-flow turbine wheel is made substantially in symmetry, thereby balancing axial forces (thrust forces) to minimize resistance against rotation, so that it achieves a rotor for a turbocharger or gas turbine engine with less losses of driving forces.

According to the invention, furthermore, as shown in FIG. 8 the radial-flow turbine wheel can utilize the pressures on the upstream portions of the blades to increase the components for driving the disc in comparison with the prior art (FIG. 3), whereby the number of the blades can be reduced. For example, it has been found that a rotor of nominal diameter 60 mm according to the invention having only nine blades sufficiently corresponds to a rotor of the same size having eleven blades in the prior art to obtain the same output.

It is further understood by those skilled in the art that the foregoing description discloses preferred embodiments of the invention and that various changes and modification may be made in the invention without departing from the spirit and scope thereof.

I claim:

1. In a radial flow turbine wheel wherein a plurality of blades extend radially outwardly from a central disc having a spindle extending axially therethrough, and wherein gas received radially between inlet portions of said blades is progressively deflected to escape axially from between outlet portions of said blades, the improvement comprising:

said blades being supported solely by said disc, with the maximum radial dimension of said disc being spaced radially inwardly from the inlet portions of said blades; and each of said blades having a curved surface configuration which is symmetrical with respect to a plane normal to said spindle and which passes through a mid-portion of the axial length of said disc, the outlet portions of said blades being both spaced radially inwardly from as well as offset axially from said inlet portions.

2. A radial-flow turbine wheel as set forth in claim 1, wherein each said blade is completely in symmetry not only in curved configuration but also in its axial length.

3. A radial-flow turbine wheel as set forth in claim 1, wherein each said blade is in symmetry in curved configuration but in symmetry in its axial length.

4. A radial flow turbine wheel as set forth in claim 3, wherein a downstream portion is greater in axial length than an upstream portion of each said blade.

* * * * *